US005816781A

United States Patent [19]

Bercot et al.

[11] Patent Number: 5,816,781

[45] Date of Patent: Oct. 6, 1998

[54] MOTOR-DRIVEN COOLING VENTILATOR

[75] Inventors: Jacques Bercot, Merey Sous Montrond; Bernard Mary, Ornans, both of France

[73] Assignee: GEC Alsthom Transport SA, Paris, France

[21] Appl. No.: 672,954

[22] Filed: Jul. 1, 1996

[30] Foreign Application Priority Data

Jul. 5, 1998 [FR] France ..... 95 08117

[51] Int. Cl.[6] ..... F04B 17/00

[52] U.S. Cl. ..... 417/371

[58] Field of Search ..... 417/371, 368, 417/423.14, 369; 416/213 R; 415/207

[56] References Cited

U.S. PATENT DOCUMENTS 2,191,341 2/1937 Curley .
2,488,945 11/1949 Troller et al. .
2,596,781 5/1952 Moore .
2,698,128 12/1954 Ault et al. ..... 417/423.1 X
2,900,125 8/1959 Quick ..... 417/423.14
2,956,731 10/1960 Bayuk et al. .
2,968,249 1/1961 Caine et al. ..... 417/369
3,089,637 5/1963 Bell .
5,350,281 9/1994 Hagshenas ..... 417/371

*Primary Examiner*—Ismael Izaguirre
*Attorney, Agent, or Firm*—Sughrue, Mion, Zinn, Macpeak & Seas, PLLC

[57] ABSTRACT

A motor-driven cooling ventilator comprises a motor and a ventilator fan disposed on the same axis inside a casing, and has air guide device fixed to the periphery of the stator of said motor and fixed to said casing, said air guide device being means fitted to said stator of the motor.

7 Claims, 2 Drawing Sheets

MOTOR-DRIVEN COOLING VENTILATOR

The present invention relates to motors in general, and it relates more particularly to a motor-driven cooling ventilator.

BACKGROUND OF THE INVENTION

It is known that ventilator motors can be fixed inside a casing by means of link plates or of an inside casing.

A drawback of prior art motor-driven ventilators is their large bulk for given pressure/flowrate performance.

Another drawback of prior art motor-driven ventilators is their great weight and their lack of mechanical strength.

OBJECTS AND SUMMARY OF THE INVENTION

Thus, an object of the invention is to provide a motor-driven cooling ventilator of smaller bulk relative to its performance in terms of pressure/flowrate, of smaller mass, and that generates a lower level of sound pressure.

According to the invention, the motor-driven cooling ventilator comprises a motor and a ventilator fan disposed on the same axis inside a casing, and has air guide means fixed to the periphery of the stator of said motor and fixed to said casing, said air guide means being means fitted to said stator of the motor.

The motor-driven cooling ventilator of the invention also satisfies at least one of the following characteristics:

- said air guide means are fixed directly, in part or in full, to the magnetic laminations of the stator of said motor and to endpieces forming the shell of said motor;
- said air guide means are obtained by a welding method;
- said air guide means are guide vanes;
- said casing is made up of a first half-casing holding said air guide means and by a second half-casing for the ventilator; and
- said casings or said half-casings are obtained by a welding method.

The advantages of the motor-driven cooling ventilator of the invention are an improvement in the efficiency of the ventilator, in the cooling of the motor, and in the mechanical strength of the assembly.

Another advantage of the motor-driven cooling ventilator of the invention is a reduction of noise level.

When occupying the optimum point on the pressure/flowrate curve, the motor-driven cooling ventilator of the invention can enable noise level to be reduced by as much as 10 dB.

In addition, the motor-driven cooling ventilator of the invention makes it possible, for example, to obtain machines weighing about 135 kg, that are comparable in other respects with prior art machines that weigh about 300 kg.

BRIEF DESCRIPTION OF THE DRAWINGS

Other objects, characteristics, and advantages of the invention appear on reading the following description of a preferred embodiment of the motor-driven cooling ventilator of the invention, which description is made with reference to the accompanying drawings, in which.

MORE DETAILED DESCRIPTION

Figure 2:
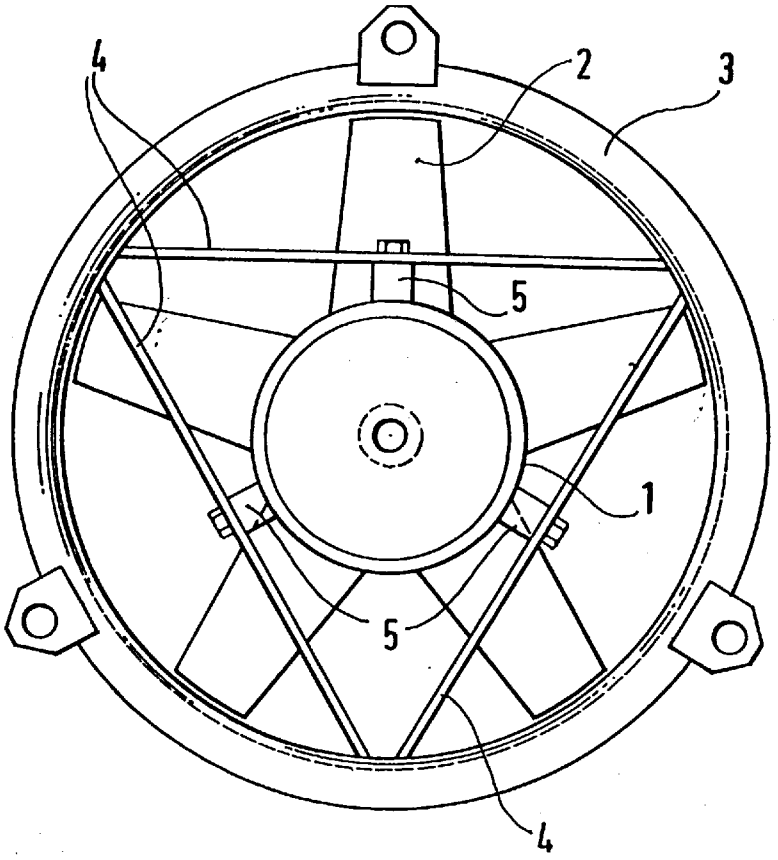
FIG.2 PRIOR ART
FIG. 2 is a front view of the FIG. 1 cooling ventilator.
Figure 1:
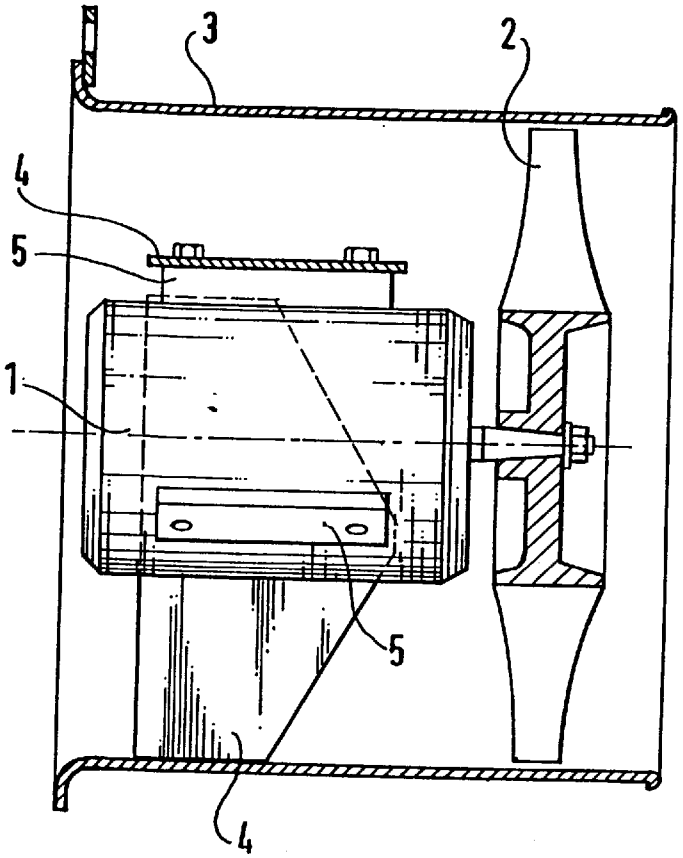
FIG.1 PRIOR ART
FIG. 1 is a side view of a prior art motor-driven cooling ventilator.

FIGS. 1 and 2 are respectively a side view and a front view of a prior art motor-driven cooling ventilator.

The prior art motor-driven cooling ventilator comprises a motor 1 and a ventilator fan 2.

The motor 1 is fixed inside a casing 3.

The casing 3 is a peripheral shaped annular casing designed to be fit closely round the tips of the fan blades of the ventilator.

The purpose of the casing 3 is to channel the air set into motion by the ventilator blades.

The fan 2 of the ventilator is constrained to rotate with the rotor of the motor 1. The motor 1 and the ventilator 2 are mounted on the same axis inside the casing 3 to enable the ventilator fan to rotate inside the casing 3.

The motor 1 is fixed inside the casing 3 by means of link plates 4 that are bolted to stiffener bars 5.

There are three stiffener bars 5 which are fixed around the stator of the motor 1 of the motor-driven cooling ventilator.

The stiffener bars 5 are welded to the stack of magnetic laminations constituting the stator of the motor 1.

The stiffener bars 5 are disposed at 120° to one another.

The link plates are also fixed by welding or bolting to the inside wall of the casing 3.

Figure 4:
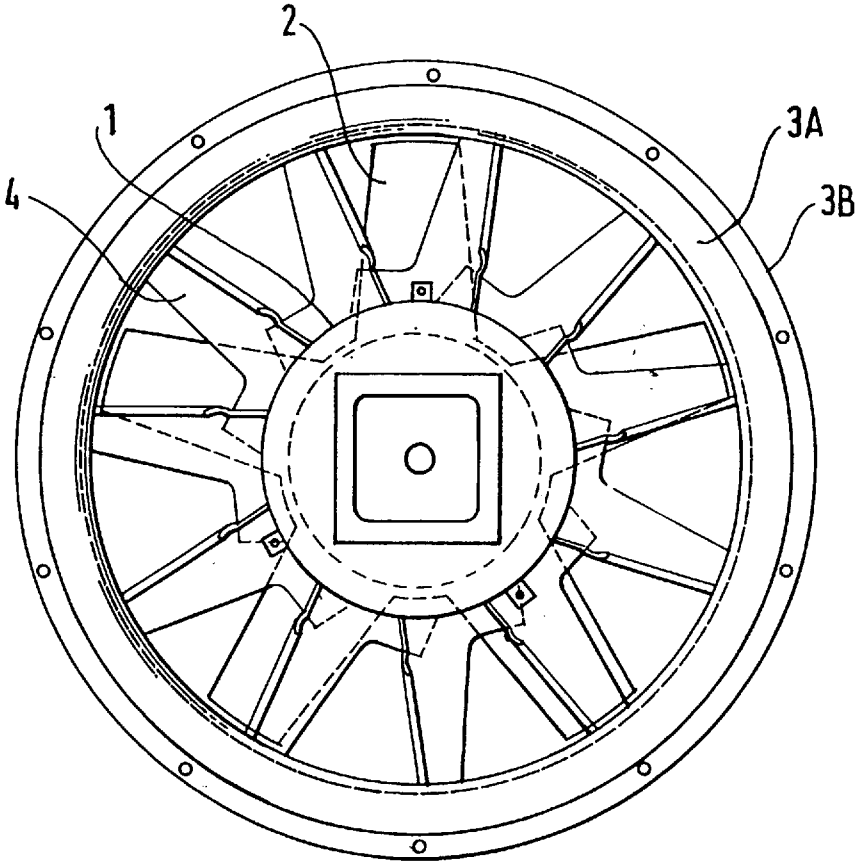
FIG. 4 is a front view of the FIG. 3 motor-driven cooling ventilator.
Figure 3:
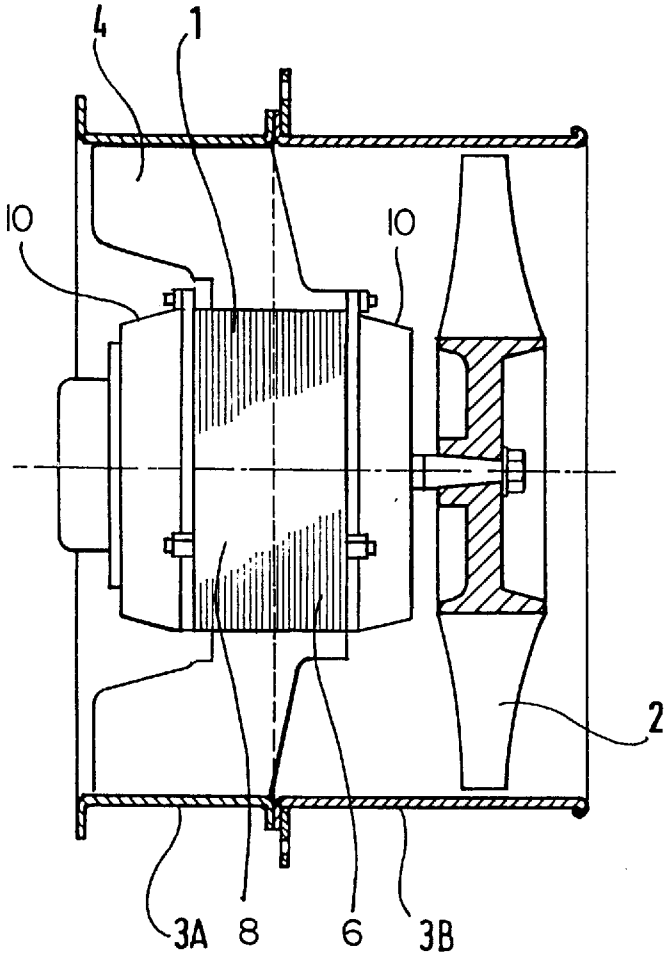
FIG. 3 is a side view of the preferred embodiment of the motor-driven cooing ventilator of the invention.

FIGS. 3 and 4 are respectively a side view and a front view of the preferred embodiment of the motor-driven cooling ventilator of the invention.

The motor-driven cooling ventilator of the invention comprises a motor 1 and a ventilator fan 2 disposed on the same axis inside a casing 3.

In accordance with an essential characteristic of the invention, air guiding means 4 are fixed to the periphery of the stator of the motor 1 and they are fixed to the casing 3, and preferably to the inside wall of the casing 3.

In a preferred embodiment, the air guide means 4 are fixed, e.g. by welding, directly, in part or in full to the magnetic laminations 8 of the stator 6 of the motor 1 and to the endpieces 10 forming the body of the motor 1.

By way of example, the air guide means 4 may be obtained by a welding method. It is clear that any other manufacturing method could be used.

In another example, the air guide means 4 are means applied to the stator of the motor 1.

The casing 3 is preferably a one-piece element, but it could also be made up of a first half-casing 3A holding the air guide means 4 and of a second half-casing 3B for the ventilator proper.

By way of example, the casings 3, 3A, and 3B may be obtained by a welding method.

The air guide means 4 are preferably guide vanes.

The orientation and the number of air guide vanes are determined to optimize the air efficiency of the ventilator by channelling the stream of air produced by the motor-driven ventilator.

As mentioned above, the motor-driven ventilator of the invention can increase the efficiency of the axial ventilator and reduce the noise it emits.

Nevertheless, a fundamental advantage of the motor-driven ventilator of the invention is that it improves cooling of the motor because of the air guide means, which have a function of securing the motor shell and of holding the motor in the casing, and which also behave as the cooling fins of a radiator.

It can be seen from the above that the bulk of a motor-driven ventilator of the invention is reduced for given pressure/flowrate performance.

We claim:

1. A motor-driven cooling ventilator comprising a motor and a ventilator fan disposed on the same axis inside a casing, the ventilator having air guide means fitted to the stator of said motor and fixed to said casing.

2. A motor-driven ventilator according to claim 1, in which said air guide means are fixed directly, in part or in full, to the magnetic laminations of the stator of said motor and to endpieces forming the shell of said motor.

3. A motor-driven ventilator according to claim 1, in which said air guide means are welded to said stator of said motor.

4. A motor-driven ventilator according to claim 1, in which said air guide means are guide vanes.

5. A motor-driven ventilator according to claim 1, in which said casing is made up of a first half-casing holding said air guide means and by a second half-casing for the ventilator.

6. A motor-driven ventilator according to claim 5, in which said half-casings are welded together.

7. A motor-driven ventilator according to claim 1, wherein said air guide means is welded to said casing.

* * * * *